United States Patent [19]

Lindblom et al.

[11] Patent Number: 4,925,173

[45] Date of Patent: May 15, 1990

[54] APPARATUS FOR ASSEMBLING AND DEPOSITING SIGNATURES

[75] Inventors: Kurt L. Lindblom, Trollhattan, Sweden; Jussi J. Similä ; Seppo J. Kanervo, both of Järvenpää , Finland

[73] Assignee: Miller-Johannisberg Druckmaschinen GmbH, Weisbaden-Biebrich, Fed. Rep. of Germany

[21] Appl. No.: 225,245

[22] Filed: Jul. 27, 1988

[30] Foreign Application Priority Data

Jul. 30, 1987 [DE] Fed. Rep. of Germany ..... 3725225

[51] Int. Cl.[5] ..... B65H 39/02

[52] U.S. Cl. ..... 270/54; 270/58; 270/60; 271/315

[58] Field of Search ..... 270/18, 19, 21.1, 52, 270/54, 55, 57, 58, 60; 271/187, 315

[56] References Cited

U.S. PATENT DOCUMENTS

| | | | |
|---|---|---|---|
| 4,556,212 | 12/1985 | Nogi | 271/187 |
| 4,736,936 | 4/1988 | Hertel | 270/58 |

FOREIGN PATENT DOCUMENTS

| | | | |
|---|---|---|---|
| 2842481 | 4/1980 | Fed. Rep. of Germany | 270/58 |
| 2569171 | 2/1986 | France | 271/315 |
| 95069 | 1/1983 | Japan | 270/58 |

*Primary Examiner*—Robert E. Garrett
*Assistant Examiner*—Therese M. Newholm
*Attorney, Agent, or Firm*—Carothers & Carothers

[57] ABSTRACT

An apparatus for assembling and depositing book signatures by means of signature-receiving compartments which are movable independently of one another and independnetly of a common rotary hub on which the compartments are carried to provide improved signature receiving, stacking, aligning and discharge, among other benefits.

19 Claims, 2 Drawing Sheets

APPARATUS FOR ASSEMBLING AND DEPOSITING SIGNATURES

BACKGROUND OF THE INVENTION

Figure 1:
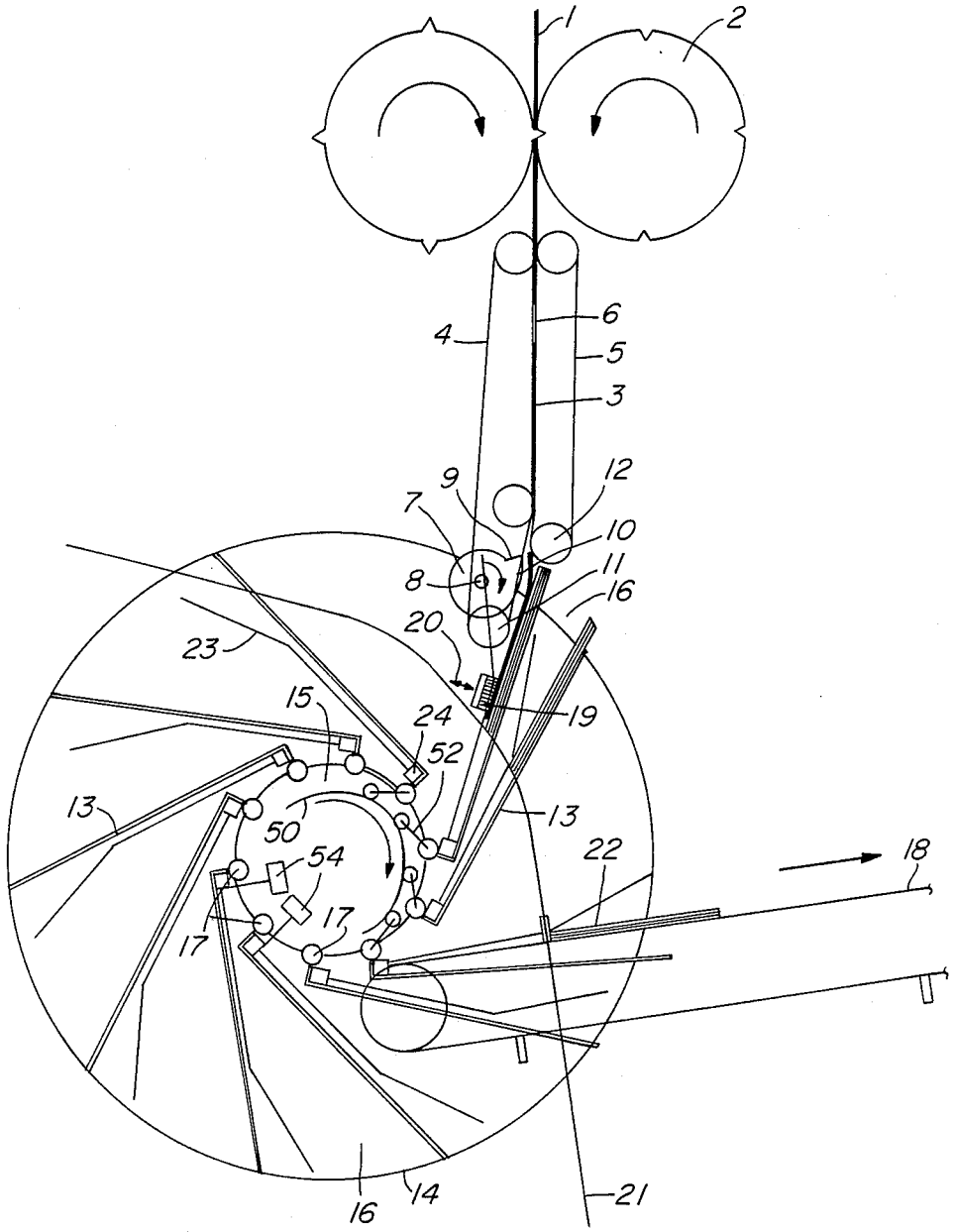

In the book making arts there is known a device for assembling and depositing book signatures which typically are out transversely from a continuous band. Such a known device is operable to separate the succession of signatures from one another by an accelerating means, the signatures also being laterally adjustable relative to one another between fore-running and after-running edges, respectively, by steering-out means operable synchronically with the signature cycle. The signatures can be assembled during an assembly cycle in input compartments formed by the vanes of an impeller wheel that is driven synchronically with the assembly cycle, and can be ejected from the compartments onto a removal means, a conveyor belt, for example. To accommodate the use of the multi-compartment impeller wheel, the signature cycle is an integral multiple of the assembly cycle.

The impeller wheel of such an apparatus includes a plurality of circumferentially distributed, rigidly mounted vanes which, in conjunction with other elements, form the respective signature receiving compartments. The signature piles in the separate compartments of the impeller wheel are not supported by prior art devices either in the longitudinal or the transverse direction. Consequently, it has been virtually impossible to produce cleanly aligned inner books during the assembly of individual signatures as every single signature can slide freely in the assembly compartment during rotation of the impeller wheel and as well during the setting down of the inner book onto the removal means.

These problems are exacerbated when the signatures comprise plural folded sheets so that the possibility exists of the signatures "bulging" adjacent the folded edge of the individual sheets. This bulging effect increases with greater numbers of sheets in a signature.

Another known device comprises an impeller wheel having vanes mounted so as to be pivotable about an axis. This device, however, is a piling unit for a sheet counting apparatus and the vanes thereof are not controlled for the whole of their circumferential path but instead are primarily under the influence of centrifugal force. A pivotal control of the individual vanes is effected only to provide some limited working function, for example for the purpose of reducing the diameter of the circle on which the tips of the vanes move in operation, the purpose being to limit the space requirements of the apparatus.

BRIEF SUMMARY OF THE INVENTION

The apparatus according to the instant invention makes possible, in a minimum of space, the cutting to size, assembly, alignment and setting down of inner books made up of signatures. The apparatus is very compact, is operable at very fast cycle speeds, and can be quickly and easily adjusted to accommodate the format of signatures of differing length, breadth and thickness. An exact formation or assembly of inner books from the signatures thus is assured, and a very high working speed, for example exceeding six thousand signature pieces per hour, can be achieved.

The invention contemplates an apparatus comprised of an impeller wheel having a hub with an axis on which the wheel is rotatable, and a plurality of signature receiving compartments distributed circumferentially of the wheel and formed by vane structures preferably mounted in the wheel hub structure. Control means such as a cam plate and roller type cam followers, for example, are provided to control pivotal motion of the compartment vanes with respect to the wheel hub during rotation of the impeller wheel about its axis to enhance the signature assembly process. Under the influence of the respective control means, the compartment vanes are moved quickly into a signature receiving position before the same would otherwise reach such a position as a result of their circular motion concomitant with rotation of the impeller wheel, their movement then being slowed to a rate slower than the rotation of the impeller wheel in a manner to facilitate assembly of the inner books in the respective compartments by providing movement of the compartments, with respect to the signature insertion point that is coordinated to the signature thickness and deposit rate. Subsequently, further control over the rotary movement of the compartments facilitates deposit of the assembled inner books on a removal means such as a conveyor.

Further according to the invention, signatures are delivered to the compartments of the impeller wheel by an accelerating means which may comprise elongated continuous bands trained on pulleys or rollers and each driven at the same speed with a run of each band bordering on one or the other of the opposed sides of the signatures. The bands are led through an aperture formed by directional or reversing rollers to ensure uniform guidance of the signatures by the bands. A directional roller on the vane side of an impeller wheel compartment may be positioned outside the radial reach of the rotating impeller wheel vanes, and a reversing roller for a band opposing the above mentioned band on the vane side may be mounted within the radial reach of the impeller wheel vanes such that a steering-out means is spanned by this opposed band.

The signature receiving compartments on the impeller wheel may include not only the vanes as above specified but opposed spring means as well to guide and contain the signatures. The above mentioned opposed bands thus may be referred to as being disposed, respectively, on the spring side, and the vane side, of the compartments.

For limiting the depth of the input compartments in the direction of the wheel hub (i.e. the radially inward direction) a permanently mounted guide track is expediently provided, the track being stationary in operation but adjustable according to the length of the signatures being assembled in the respective compartments.

In order to slow the movement of the signatures on insertion thereof into the compartments of the impeller wheel, there is provided on one side of the compartment a braking device preferably comprised of a brush-like structure with bristles turned inward toward the impeller wheel vanes, which braking device is adjustable generally toward and away from the respective vane. Through the braking effect of the braking device, the signatures, which arrive at a fairly high speed in the individual compartments, are slowed before impacting onto the inner limit of the input compartment which is the guide track. As a result, undesirable fluttering or folding movements of the signature pages are avoided. The adjustability of the braking device provides for adaptation to the kinetic energy of the individual signatures which energy depends in turn on their mass and velocity of insertion into the compartments.

Figure 2:
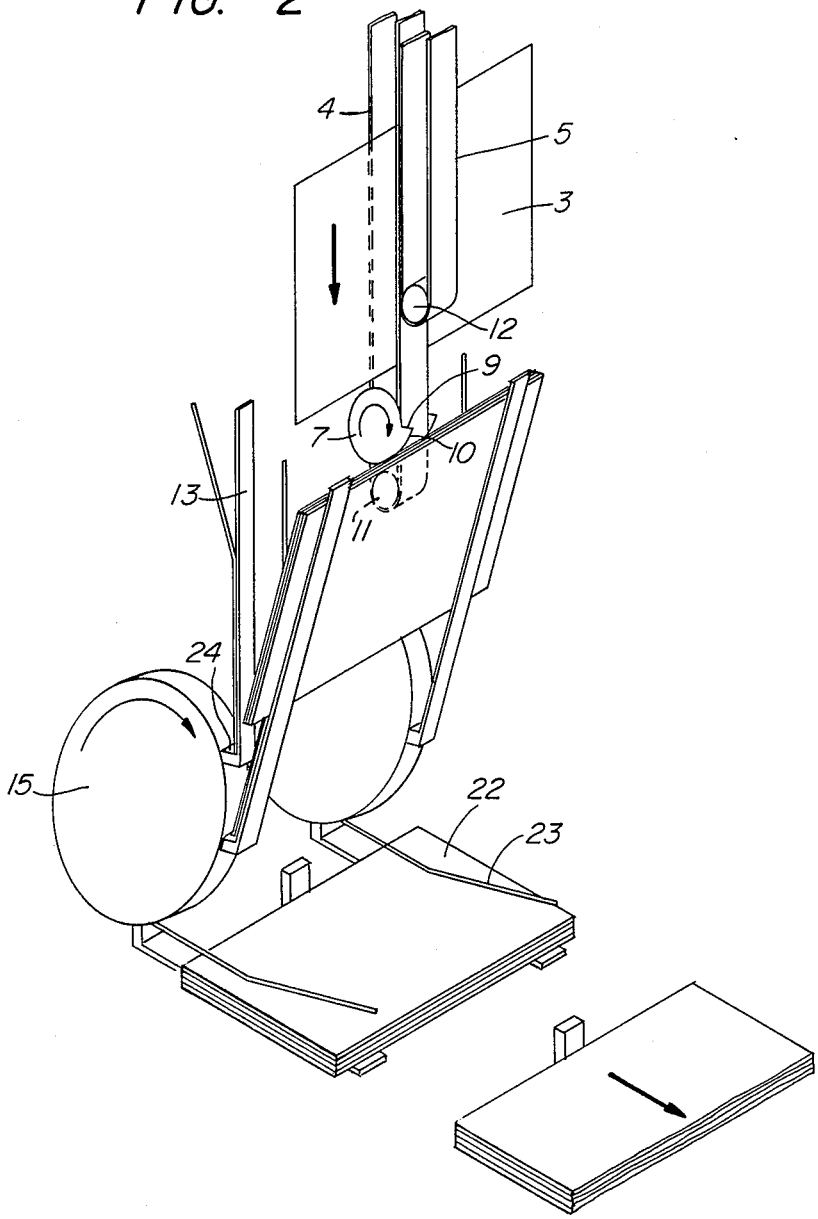

The above and other aspects of the invention will be more readily appreciated upon consideration of the following detailed description and the accompanying drawings, in which:

FIG. 1 is a generally schematic side elevation of an assembling and a depositing apparatus according to one presently preferred embodiment of the instant invention; and FIG. 2 is a perspective view of the assembling and depositing apparatus of FIG. 1.

Referring to FIGS. 1 and 2, an apparatus according to one presently preferred embodiment of the invention comprises an impeller wheel 14 which carries thereon a plurality of circumferentially distributed signature receiving compartments 16, each of which is formed in part by vanes 13 which project generally radially from a hub portion 15 of wheel 14. The wheel 14 is rotatable on an axis to move the respective compartments 16 in continuous succession past an input point whereat signatures 3 are deposited into the compartments 16 in a predetermined signature assembly process. The signatures 3 are cut from an incoming band package 1 of printed matter or the like which runs through a cutting device 2 where it is transversely cut into the individual signatures 3. The cutting device 2 is followed by an accelerating means in the form of pluralities of orbiting bands 4, 5 all driven at the same speed, and each band having a run bordering on one or the other of the opposed sides of signatures 3. Due to the acceleration achieved by the bands 4, 5, spaces, separations or gaps 6 are produced between successive signatures 3.

Adjacent the lower ends of the accelerating means there is a row of rotary cam levers 7 (only one shown in FIGS. 1 and 2 in FIG. 2) which are driven in timed relation with respect to the input of the signatures 3. The cam levers 7 rotate on a common axis 8 that extends perpendicular to the direction of motion, and parallel to the plane of motion of the signatures 3. Each cam lever 7 is provided with a shelf 9 on which the signatures 3 impact as they move downwardly, the shelf 9 being oriented generally radially to the axis 8 and facing the input direction (ie, facing the incoming signatures 3, as shown). From the radially inner extent of each shelf 9 runs a discard surface or face 10 that increases in radius with increasing extent of the surface 10 about the circumference of the cam lever 7 to join shelf 9 again at its radially outermost extent. By means of the face 10, every signature 3 discharged by the shelf 9 is pressed (with its upper end in its horizontal starting position) toward the outside or away from cam lever 7 and toward the respective vane 13, before the return of the shelf 9 to its starting position. Thus, the succeeding signature 3 can fall downwards into the compartment 16 beside the immediately prior signature 3 without hindrance.

To ensure the exact guidance of the signatures 3, the lower directional or reversing roller 11, with a run of the band 4 lying on the same side of the signatures 3 as the cam lever 7, is located below the cam lever 7. By contrast, the lower directional or reversing roller 12 of band 5 on the opposed side of signatures 3 is located radially outward of the outer tips of the vanes 13. As above described, vanes 13 are carried by impeller wheel 14 and each comprises a row of adjacent vane blades (only two being shown for each row in FIG. 2). Each input compartment 16 of the impeller wheel 14 is bounded, respectively, by a vane 13 of the impeller wheel 14, and by a respective plurality of leaf or wire springs 23, preferably one leaf spring 23 being attached to the back of each vane blade. A stationary but selectively adjustable guide track 21 (FIG. 1) extends within the radial dimension of the compartments 16 for a portion of their rotary travel with wheel 14.

All the vanes 13 are mounted preferably on hub 15 of wheel 14 so as to be pivotable about respective pivot axis 17 which extend parallel to the rotational axis of the impeller wheel 14. In each revolution of impeller wheel 14, the vanes 13 are pivotally moved about the respective pivot axes 17 by means of a control such as a control cam plate 50 which cooperates through roller levers 52 or the like with the respective vanes 13. Elements 50 and 52 are shown schematically and are not intended as shown to represent actual operating element configurations. The circumferential speed of the impeller wheel 14 may vary during rotation thereof but it is in toto adapted to the input rate of the individual signatures 3.

In operation, initially each vane 13 is positioned, in succession, in closely spaced relation with respect to the signature release point adjacent the shelves 9 of the respective cam levers 7 and is turned away slightly in a diagonal direction with respect thereto as shown in FIG. 1. During the release of the succession of signatures 3 from shelf 9, the vane 13 is advanced more slowly than the rotation of wheel 14 would advance it due to a retarding action imposed by control cam plate 50 in cooperation with roller followers 52 to accommodate the increasing thickness of the pile of signatures being deposited in the compartment 16. After the release of a given number of signatures 3 which are assembled side by side in the compartment 16 to form an inner book 22, the compartment 16 is then moved on quickly due to an accelerating action imposed by the control elements 50 and 52, while the next in succession vane 13 is moved ( more rapidly than the rotation of wheel 14 would move it there) to the initial or starting position adjacent shelf 9, also due to an accelerating effect of control elements 50,52. Concurrently, the preceding vane 13 together with the inner book 22 assembled on it is decelerated toward a cog conveyor belt 18 by the same control elements 50,52 in the last part of this portion of the compartment movement cycle. The inner book 22 is guided along guide rail 21 until deposited onto the cog conveyor belt 18. This cycle is repeated in continuous sequence for each successive compartment 16 of wheel 14.

In each input compartment 16 of the impeller wheel 14 where signatures 3 are received and assembled, there is provided below the cam lever 7 and shortly in front of the innermost side of the compartment 16 and generally adjacent to guide track 21, a braking device comprised preferably of a brush-like structure 19 having a plurality of bristle elements directed toward the vane 13 which bounds the opposed side of the respective compartment 16. Brush 19 is adjustable toward and away from the vane 13 as indicated by adjusting means 20.

To slow the movement of and hold together the inner book 22 being assembled in a given compartment 16 as above described, each vane 13 includes a plurality of leaf or wire springs 23 roughly aligned therewith instead of or in addition to the brush 19. The springs 23 may be adjustable separately or jointly as by any suitable adjustment means 54, shown schematically as being mounted in the hub of impeller wheel 14, for example.

The springs 23 serve to press the signatures 3 onto one another as they are guided in succession into the compartment 16, thus slowing their movement and holding them together so that the inner book 22 being formed thereby is held together in a uniform packet of aligned sheets or signatures throughout the assembly process and as they are deposited onto the cog conveyor belt 18.

The invention having thus been described in accordance with statutory provisions, it is to be understood that we have contemplated various alternative and modified and embodiments apart from those above described, and certainly such would also occur to others versed in the art once apprised of our invention. Accordingly, it is our intent that the invention be construed broadly and limited only by the scope of the claims appended hereto.

We claim:

1. In an apparatus for assembling and depositing signatures including input compartments formed by generally radially projecting vane means on an impeller wheel that is rotatably driven synchronically with a signature assembly cycle and ejecting means for ejecting the signatures from said input compartments and onto a removal means, the combination comprising:

pivotal mounting means mounting said vane means for pivotal movement thereon about respective axes which extend generally parallel to the rotary axis of said impeller wheel;

control means for controlling pivotal movement of said vane means about said respective axes during regular rotary movement of said wheel about said rotary axis such that the said vane means of each said compartment to be loaded with such signatures is initially moved independently of others of said vane means in a phase of quick insertion movement, with respect to the rotary movement of said wheel, to an initial signature input position to receive such signatures followed by a phase of relatively slower movement in an assembly angle region during assembly of such signatures therein and a subsequent phase of relatively quicker movement to a final signature input position.

2. The combination as set forth in claim 1 additionally including an accelerating means for feeding such signatures into said input compartments at said initial signature input position.

3. The combination as set forth in claim 2 wherein said accelerating means comprises a plurality of band means carried by respective roller means and driven at a common orbital speed and each said band means including a run disposed adjacent one or the other of the opposed sides of such signatures.

4. The combination as set forth in claim 3 wherein said band means includes at least one band extending adjacent the vane side of the said compartment positioned adjacent said band means, wherein said roller means thereof includes a lower direction reversing roller positioned outside of the radial reach of said vanes and said at least one band includes a run extending adjacent one side of such signature.

5. The combination as set forth in claim 4 additionally including a steering out means positioned adjacent said initial signature input position and operable in cooperation with said impeller wheel and said accelerating means to guide a succession of signatures into the respective said compartments.

6. The combination as set forth in claim 5 wherein said band means includes at least another band opposing said at least one band and including a run which is engageable with the side of such signatures opposed to said one side thereof.

7. The combination as set forth in claim 6 wherein said steering out means is spanned by said another band.

8. The combination as set forth in claim 7 wherein said another band includes a lower direction reversing roller means disposed within the radial reach of said vanes.

9. The combination as set forth in claim 1 including a guide track means which is adjustably located with respect to the path of motion of said input compartments from said initial signature input position to the said discharge position, said guide track being adjustable in accordance with the length of the signatures being assembled to provide a corresponding limit on the length of the respective said input compartments generally in the radial direction with respect to said wheel according to the corresponding dimension of the signatures being assembled.

10. The combination as set forth in claim 9 additionally including a braking means which is cooperable with said compartments to slow the movement of the respective signatures being assembled in the compartments.

11. The combination as set forth in claim 10 wherein said braking means includes a brush-like means with bristle elements spaced from and projecting toward the respective said vane means.

12. The combination as set forth in claim 11 wherein said brush-like means includes adjustment means for adjustment thereof toward and away from the respective said vane means.

13. The combination as set forth in claim 1 wherein said wheel includes a hub portion and said vane means are pivotally mounted to said hub portion.

14. The combination as set forth in claim 13 wherein said control means includes means cooperable with said wheel for controlling movement of said vane means.

15. The combination as set forth in claim 14 wherein said control means includes cam means and cooperable follower means associated with each said vane means.

16. The combination as set forth in claim 1 wherein each said compartment is formed additionally in part by elongated spring means extending adjacent each respective said vane means and spaced therefrom to form the respective said compartments between respective pairs of adjacent ones of said elongated spring means and vane means.

17. The combination as set forth in claim 16 additionally including adjustment means operable to adjust the spacing between said vane means and the respective said elongated spring means.

18. An apparatus for assembling and depositing signatures comprising:

a wheel means rotatably mounted on an axis of rotation;

a plurality of signature receiving compartment means carried by said wheel means;

each said compartment means being pivotally movable with respect to said wheel means and independently of all others of said compartment means;

and control means for controlling the independent pivotal movement of each of said compartment means with respect to said wheel means and said others of said compartment means in a manner that the movement of said compartment means due to the influence of said control means and the rotation of said wheel means for assembly of such signatures within said compartment means includes an initial phase of movement faster than the relative rotary movement of said wheel means to an initial signature insertion position followed in sequence by a second phase of movement within a given angle of rotation from said initial position at a rate slower than said initial phase of movement and a third phase of movement to a final signature input position at a rate faster than said second phase of movement.

19. The apparatus as set forth in claim 18 wherein said control means is further operative to move said compartment means, in conjunction with rotation of said wheel, in a manner to decelerate said compartment toward a signature release position thereof subsequent to said further phase of movement.

* * * * *